US006653784B2

(12) United States Patent
Lu

(10) Patent No.: US 6,653,784 B2
(45) Date of Patent: Nov. 25, 2003

(54) TYPE OF LIGHT

(76) Inventor: Li-Cheng Lu, No. 11, Lane 378, Chung Shan Rd., Hsinchu (TW)

( * ) Notice: Subject to any disclaimer, the term of this patent is extended or adjusted under 35 U.S.C. 154(b) by 167 days.

(21) Appl. No.: 09/912,840

(22) Filed: Jul. 25, 2001

(65) Prior Publication Data

US 2001/0045799 A1 Nov. 29, 2001

Related U.S. Application Data

(63) Continuation of application No. 09/411,336, filed on Oct. 1, 1999, now Pat. No. 6,326,728.

(51) Int. Cl.[7] ..... H01K 1/00
(52) U.S. Cl. ..... 313/623; 313/578; 315/74
(58) Field of Search ..... 313/634, 573, 313/623, 578, 271, 493; 315/74

(56) References Cited

U.S. PATENT DOCUMENTS 3,654,512 A * 4/1972 Spiteri ..... 313/578 X
5,384,510 A * 1/1995 Arnold ..... 313/578 X
5,910,707 A * 6/1999 Cheng et al. ..... 313/578 X

* cited by examiner

*Primary Examiner*—Ashok Patel
(74) *Attorney, Agent, or Firm*—Dickinson Wright PLLC

(57) ABSTRACT

A new type of light includes a casing used for containing an emitting device. Further, the emitting device includes a couple of wires, an insulator ball, a filament and a fuse. The couple of wires are connected with a power supply via the casing, wherein the contact points of wires and casing are defined as the bottom of the light. Moreover, the insulator is posited above the bottom of light. Subsequently, the filament is posited above the insulator ball, and the fuse is posited on the top of wires. Particularly, the tops of wires are wound to form hooks to hold the fuse. The hooks are flattened for increasing the adhesion of connection between wires and fuse.

5 Claims, 2 Drawing Sheets

TYPE OF LIGHT

This is a continuation-in-part of U.S. patent application Ser. No. 09/411,336, filed Oct. 1, 1999, now U.S. Pat. No. 6,326,728.

FIELD OF THE INVENTION

The present invention generally relates to a new type of light, and more particularly, relates to a new type of light comprising a filament, a fuse, a couple of conductors and an insulator. Further, the relative position between the filament and the fuse is changed to improve the reliability of the light.

BACKGROUND OF THE RELATED ART

Since T. A. Edision has disclosed the first light in 1880s, the human being uses many kinds of illuminations. So that the life in the night becomes more diversiform. The illuminations are used in adornment and in brightening. The power of light emitting is following as Ohm's law as $W=V^2/R$, wherein the V is denoted as the loading voltage of the circuit and R is indicated as the resistance. Otherwise, the principle of light emitting is indicated as the "Black body emission" principle. The principle indicates the relationship between wavelength of emitting light and temperature of emitting source (for example, the human being emits the IR at room temperature). Hence, the visible light can be generated by using a suitable material, such as tungsten, which the tungsten is preferably heated to about 3,000° C. The suitable material must be chemical stable at the high temperature. Referring to FIG. 1, a cross sectional view of a conventional light 10 is shown therein.

Furthermore, the accumulation of experiences in the human's life, people has developed more complex structure of light, such as a light containing a fuse. The fuse of the light is used to prevent the excess of using electric power. The light containing the fuse is shown as FIG. 2. The light 20 is composed of a tungsten wire 23, a fuse 25, an insulator 24 and a couple of wires 22. All of the elements of the light 20 are contained in a casing 21. All of the elements are mounted as the sequence as following: the couple of wires 22 are fitted through the bottom of the casing 21 wherein the pinnacles of the couple of wires 22 are formed as hooks. Further, the filament 23 is hooked between the hooks of the couple of wires 22. Moreover, a fuse 25 is wound around the couple of wires 22 for protecting the circuit, wherein the position of the fuse 25 is under the filament 23. In a string of lights, one or more lights are failure due to all the lights on the circuit of the string. The fuse 25 is used for preventing all of lights on the string being disabled. For insulation, an insulator ball 24 is used between the couple of the wires for fixing purpose.

The light 20 described above, the fuse 25 is usually wound around the couple of wires 22. The fuse 25 may loose according to the filament being heated at high temperature. According to the lights of ornaments are unavoidable shifted so that the wires are easily loosened with the wires 22.

SUMMARY OF THE INVENTION

According to one aspect of the invention, there is provided a new type of the light. The disclosed new type of the light has excellent coupling reliability of the fuse. Therefore, the light of the present invention has the advantage to prevent vibration of the surroundings.

In one embodiment of the present invention, the disclosed light is composed of an insulator ball, a filament and a fuse connected to a couple of conductive wires in a sequence from the bottom of the light. Further, all of the components are contained in a casing.

In another embodiment of the present invention, the light is also composed of an insulator ball at the bottom, a filament disposed atop of the conductive wires, a fuse disposed between the insulator ball and the filament. In order to prevent loosened of the fuse, the fuse is fastened in one end with two spiral circles for clockwise direction and another end with two spiral circles for counterclockwise direction.

The above and other features, particularity, and advantages of the invention will be more readily apparent from reading of the following detailed description of the invention taken in conjunction with the accompanying drawings.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
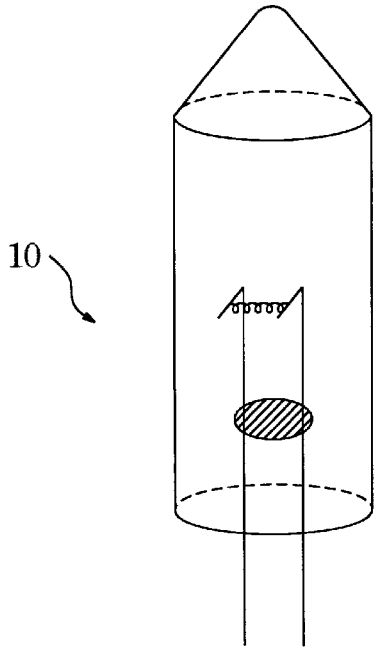
Fig.1 ( Prior Art )
FIG. 1 shows a cross-sectional view of an original light.
Figure 2:
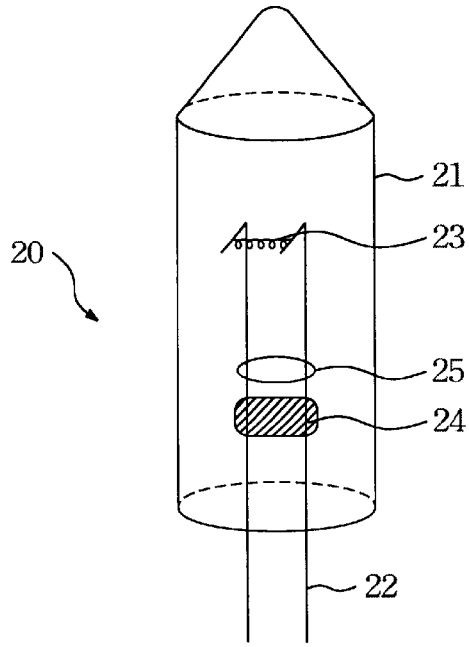
Fig.2 ( Prior Art )
FIG. 2 shows a cross-sectional view of a prior art of a light with a fuse.
Figure 3:
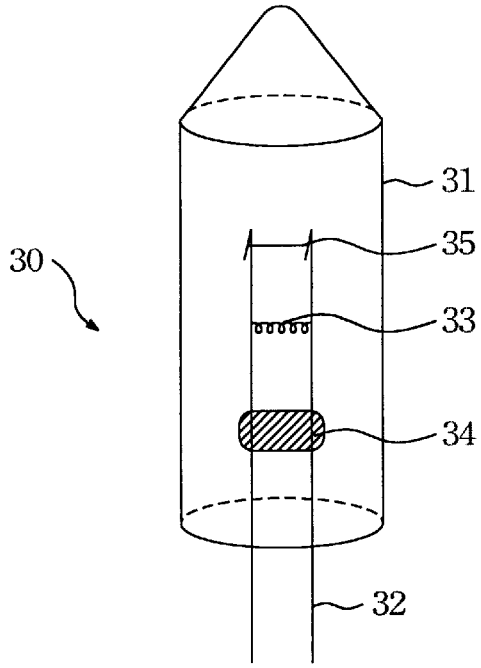
FIG. 3 shows a cross-sectional view of the light according to a first embodiment of the present invention.

Referring to FIG. 3, the light 30 according to a first embodiment of the present invention is composed of a filament 33, a fuse 35 and an insulator ball 34 wherein all of them are connected between a couple of wires 32. Further, all of the components are contained in a glass-casing 31, and the wires 32 are connected to a power supply outside the casing 31.

According to the present invention, the casing 31 can be the material selected from a group consisting of glass, color glass and any kinds of color plastic casings. The casing contains an emitting device which will radiate light beam, a couple of wires 32 extends from the casing 31 and couples to the power supply. The wires can be formed by an alloy, such as the copper and magnesium.

The emitting device in the casing 31 consists of the couple of wires 32 wherein an insulator ball 34 is located at the lower end of the wires 32 near bottom of the casing 31 and space apart the wires 32 to provide insulation of the wires 32, a fuse 35 is located atop the wires 32, and a filament 33 is disposed between the insulator ball 34 and the fuse 35. The connecting points of the wires 23 and casing 31 is defined as the bottom of the light 30. The detailed position of the components of the emitting device is as following: The insulator ball 34 is positioned about 10–20 mm from the bottom of the light 30. The insulator ball 34 is selected from a group consisting of glass, ceramic or plastic. Successively, the filament 33 is positioned about 5–10 mm above the insulator ball 34. Finally, the fuse 35 is positioned on the top of the couple of wires 32 wherein the top of wires are wound as hooks to connect to the fuse 35, and the distance between the top of wires 32 and filament 33 is about 3–4 mm. In order to fasten the fuse 35 and wires 32, the hooks are pressed and flattened. By pressing the hooks of the wires 32, the connecting function between the fuse 35 and wires 32 become more rigidly. According to the first embodiment of the present invention, the reliability of the connection between fuse 35 and wires 32 is increased. Therefore, the problem of the conventional ornament lights that are easy failure according to the vibrations from the surroundings can be resolved.

Figure 4:
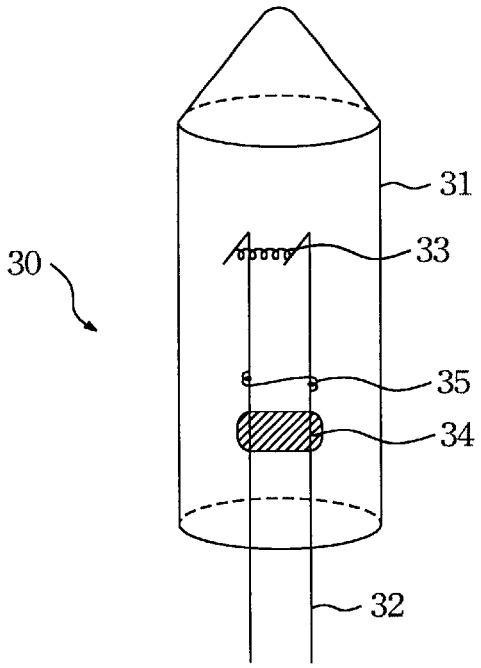
FIG. 4 shows a cross-sectional view of the light according to a second embodiment of the present invention.

Referring now to FIG. 4, the figure shows a second embodiment of the present invention. Due to the unreliable fixing of the fuse of conventional light, the present embodiment introduces a new structure to fix the fuse 35. In this figure, the emitting device also includes a pair of wires 32 disposed within the casing 31. The insulator ball 34 separated the wires 32 and is positioned about 10–20 mm from the bottom of the light 30. Next, the filament 33 is located atop the wires 32 and fixed according to the conventional method. Moreover, the fuse 35 is configured above the insulator ball 34 about 5–10 mm. The winding method of the fuse 35 is as follows: one end of the fuse 35 winds on one of the wires 32 with two spiral circles in clockwise direction, the other end of the fuse 35 winds on another one of the wires 32 also with two spiral circles, but in counterclockwise direction.

By using the new structure of the light, the conventional failure mode of disconnect is also avoided. Furthermore, since the length of the fuse 35 according to the second embodiment of the present invention is much shorter than conventional light, power consumption of the present invention can be reduced.

However, the sizes described above are an example such as an ornament light in celebration, and the present invention would be constricted according the sizes. While the preferred embodiment of the invention has been illustrated and described, it will be appreciated that various changes can be made therein without departing from the spirit and scope of the invention.

What is claim is:

1. A new type of light, said light comprising:

a casing;

an emitting device being encapsulated inside said casing, said emitting device further comprises:

a couple of wires extending into said casing, a bottom of said light is defined as the connecting points of said wires;

an insulator ball positioning above said bottom of said light to fitting said wires;

a fuse positioning above said insulator ball, one end of said fuse is fastened on one of said wires with a plurality of spiral circles in clockwise direction, another end of said fuse is fastened on another one of said wires with a plurality of spiral circles in counterclockwise direction; and a filament positioning above said fuse and coupling to said wires.

2. The light according to claim 1, wherein said casing is selected from a group consisting of glass and plastic.

3. The light according to claim 1, wherein said wire is formed by an alloy composed of copper and magnesium.

4. The light according to claim 1, wherein said insulator ball is selected from a group consisting of glass, plastic and ceramic.

5. The light according to claim 1, wherein said plurality of spiral circles includes two circles.

* * * * *